United States Patent [19]

Shinbori et al.

[11] 4,264,373

[45] Apr. 28, 1981

[54] METHOD OF REFINING BEET JUICE

[75] Inventors: Keisuke Shinbori; Yasuyuki Sugimoto, both of Kanagawa; Tokiya Ando; Shigeo Sakai, both of Tokyo, all of Japan

[73] Assignee: Toyo Soda Manufacturing Co., Ltd., Japan

[21] Appl. No.: 58,195

[22] Filed: Jul. 17, 1979

[30] Foreign Application Priority Data

Jul. 24, 1978 [JP] Japan ..... 53-89417
Nov. 30, 1978 [JP] Japan ..... 53-147139

[51] Int. Cl.[3] ..... C13D 3/12
[52] U.S. Cl. ..... 127/55; 210/670
[58] Field of Search ..... 127/55; 210/24, 30 R

[56] References Cited

U.S. PATENT DOCUMENTS

| | | | |
|---|---|---|---|
| 2,822,304 | 2/1958 | Gillmore | 127/55 |
| 4,045,242 | 8/1977 | Schoenrock | 127/55 X |

*Primary Examiner*—Sidney Marantz
*Attorney, Agent, or Firm*—McGlew and Tuttle

[57] ABSTRACT

A method of refining beet juice containing a colorant wherein the beet juice is contacted with an adsorbent composed of a dehydrated solid of a coprecipitated substance formed by insolubilizing metallic compounds in an aqueous solution. The adsorbent contains either a calcium or magnesium compound and also either an aluminum or iron compound. The process is conducted in a temperature range of 40°-100° C.

12 Claims, No Drawings

METHOD OF REFINING BEET JUICE

FIELD AND BACKGROUND OF THE INVENTION

This invention relates in general to a method for the decoloring and refining or purifying of beet juice.

More particularly, this invention is concerned with decoloring and refining processes which include the step of more efficiently discoloring and purifying beet juice containing colorants in sugar-manufacturing processes, by the use of adsorbent of similar type of synthetic hydrotalcite, at the temperature of 40°-100° C. or more preferably at 60°-80° C.

Also, in a first embodiment of the invention, the process includes a step for efficiently regenerating an adsorbent by replacing the adsorbate through ion exchange by contacting an adsorbent containing the adsorbate with various inorganic salts-solutions to cause the ion-exchange.

In the second embodiment of the invention, the process includes a step for efficiently regeneration, an adsorbent by removing the adsorbate through heating of the adsorbent within a temperature range as high as 750°-950° C. or preferably 800°-900° C.

Originally, sugar beet as a raw material for manufacturing the sugar does not contain any pigment, however, it is known that colorants are formed in beet juice during the sugar-manufacturing process.

These colorants are various on those types and are chemically unknown on numerous points, and yet, these are generally said to be caramel-substances, polyphenol-iron complexes, melaidine, and melanine.

Accordingly, in order to inhibit the formation of these pigments, hydrogen sulfide, ascorbic acid, sulfurous acid gas, etc., namely, deoxidizers have been used so far, without sufficient results. In the treatment os sugar cane, decoloring, purification or refinement of colored juice is performed by the combined use of activated carbon with organic ion exchange resins. However, in the treatment of beet juice, it is improper to use the activated carbon, and the decoloration is now typically being made by the combined treatment with $SO_2$ - gas (saturated or blowing-off of the gas), and organic ion exchange resins but, it is not preferable to use such gas in view of food-hygiene.

SUMMARY OF THE INVENTION

The present inventors have discovered efficient methods for decoloration and purification or refinement of beet juice at rather high temperatures of 60°-80° C. in purifying and refining processes by the use of a known adsorbent of aluminate-type a Japanese laid-open patent Gazette No. 50-153456 showing remarkable adsorbing efficacy for the treatment of sewage containing organic contaminants especially, among the recently suggested novel adsorbents. The aforesaid Japanese laid open patent gazette discloses a method treating sewage containing organic contaminants, featuring that the dehydrated solid co-precipitated substances formed by unsolubilizing the metal-ingredients in those solutions containing at least one type of the metal-ingredients selected from Mg and Ca as well as at least one type of metal-ingredients selected from Al and Fe are contacted with the sewage containing organic contaminants, thereby, making adsorption of the organic contaminants into the said solid substances.

However, the said adsorbent can be obtained by the reaction of various aluminates with more than one compound of silicates, ferrates, zincates, and alkaline-earth metals. The formed structure of the adsorbent is very similar to that of naturally occurring hydrotalcite shown with the chemical formula: $MgxAl\ [(OH)_{2x+2\frac{1}{2}}CO_3]\ (x-1)\ H_2O$ ($x=2$-$3$, $1CO_3 \leqq 4H_2O$).

Accordingly, upon using the adsorbent for decoloration and refinement of beet juice, in view of the natures of beet juice (higher viscosity, etc.), the benefits of both granulation into smaller grains and the handling by a column-flowing system, may be applied. The ordinary thermal regeneration-method adopted for adsorbents even with granulation, by the use of any binders cause crystal-granular disintegration accompanied by the release of the structural water, formed within the structure of the crystal, and results in pulverization of the adsorbent itself. Moreover, the adsorbency is markedly reduced by the regeneration. The present inventors have tested the adsorbents of aluminates which have the above natures or features with respect to the methods used for the decoloration and refinement of beet juice containing the colorants in sugar-purifying processes.

Thus, in the first embodiments of the invention, the inventors have discovered that the adsorbents of aluminates having physical adsorbency and those higher ion-exchanging action of inorganic anion of the structural atoms showed higher decoloring and refining functions even at rather higher temperature ranges of 40°-100° C. and, preferably 60°-80° C.

The inventors have also discovered that the regeneration of the said adsorbents can be efficiently performed by contacting the adsorbates and solutions of various inorganic salts to cause ion-exchange, and that the adsorbents, after regeneration, could be used repeatedly without disturbing any adsorbing function. Moreover, the mechanical strength of the adsorbents during the above process is not reduced.

Thus, the present invention is directed to a method for the refining and purifying of beet juice, including the first step of adsorbing colorants on adsorbents by contacting the adsorbents and beet juice containing the colorants at 40°-100° C. and the second step of regenerating the adsorbents by contacting the adsorbents and an aqueous solution of inorganic salts or compounds.

Moreover, in a second embodiment of the invention, the inventors have discovered greater bleaching or decoloring and refining ability even in rather high temperatures in the range of 40°-100° C. or preferably 60°-80° C. through higher activity of physical adsorbing characters, despite a slightly reduced adsorbing effect in the ion-exchanging nature possessed by the adsorbents originally after heat-treatment of adsorbents of aluminates at 750°-950° C. or preferably 800°-900° C. Also, the inventors have further discovered that the regeneration of the adsorbents can be efficiently performed at 750°-950° C. or preferably as higher as 800°-900° C., and that it is possible to repeatedly use the adsorbents after regeneration without losing the adsorbing function and without reducing the mechanical strength of the granular adsorbents during the repeated uses.

Hence, this invention relates to a method of refining or purifying beet juice which includes the first step of adsorbing of the said colorants by contacting the beet juice, containing the colorants at 40°-100° C., and the second step of regenerating the adsorbents by heating the adsorbents at higher temperatures in the range 750°-950° C.

The method of this invention is superior to the conventional sulfur dioxide gas saturating and filling method which has the defects of requiring complicated handling techniques and poor operativity.

Only contact between the adsorbents and beet juice, for its treatment, can make full decoloration and purification. Unlike the forementioned conventional method which should cover the adjustment or control of the "second filtering juice" as named in the sugar-refining process by means of adjustment of blow-gas volume towards the optimum pH 8-9, the method by this invention inevitably brings about pH 8-9 of the treating solution by the buffer-action possessed with the said adsorbents. That is, in the present invention, decoloration and refinement as well as the adjustment to the optimum pH can be performed at the same time.

It is an object of the invention to provide a method of refining beet juice having a colorant comprising the step of contacting the beet juice with an adsorbent in a temperature range of 40° to 100° C. to form an adsorbate thereby decoloring the beet juice. In accordance with a preferred embodiment of the invention the inventive technique further comprises a step of contacting the adsorbate with an aqueous solution of inorganic salt to regenerate the adsorbent. In accordance with still a further embodiment of the invention the technique further comprises heating the adsorbate to a temperature in the range of 750° to 950° C. to regenerate the adsorbent. In accordance with a further preferred embodiment of the invention, the beet juice is contacted with an adsorbent in a temperature range of 60° to 80° C. and the step of heating the adsorbate is conducted preferably in a temperature range of 800° to 900° C.

The method of the invention is preferably carried out utilizing an adsorbent which is a dehydrated solid of a coprecipitated substance formed by insolubilizing metallic ingredients in an aqueous solution containing at least one metallic ingredient selected from the group consisting of calcium and magnesium and at least one metallic ingredient selected from the group consisting of aluminum and iron.

DESCRIPTION OF THE PREFERRED EMBODIMENTS

The adsorbents, in the present invention, mean those of synthetic hydrotalcite type which is a dehydrated solid of coprecipitated substance formed by the non-dissolution of metallic ingredients in the aqueous solution containing at least one metallic ingredient selected from the group Ca, Mg, and at least one metallic ingredient selected from the group of aluminium and iron. By syhthesizing this adsorbent, it is possible to add reinforcements of solid materials such as silicic acid or silicates.

In the first step of contacting the adsorbents with beet juice containing colorants, either a batch-process or continuous technique may be utilized for the contact method of ordinary adsorbents with adsorbates at 40°-100° C., preferably 60°-80° C.

For instance, for batch processing adsorbents in powder form may be added and mixed with beet juice. After decoloration, the adsorbent is precipitated and isolated or filtered. In continuous processes granular adsorbent is filled in a column, and beet juice is circulated from the upper or lower portion of the column of the adsorbent-layer.

As for the technique of regenerating the said adsorbents in the second step, in the first embodiment of the invention, adsorbates can be isolated by circulating or contacting various inorganic salt solutions at 40°-100° C. or preferably 60°-80° C., followed by the removal of inorganic compounds attached to adsorbents by the use of cool or warm water, and again, the adsorbents can be used for adsorbing operation.

The aqueous solutions of inorganic compounds applicable for the present invention may be any solutions containing anions for making ion-exchange with adsorbates, for which, remarkable effects can be obtained by using the salts or compounds, containing $CO_3^{2-}$, $SO_4^{2-}$, or $HPO_4^{2-}$ ions having valence of two.

Accordingly, aqueous solutions having at least one compound among carbonates such as sodium carbonate or potassium carbonate, sulfates such as sodium sulfate or potassium phosphate, and phosphates such as sodium phosphate or potassium phosphate may be effectively utilized.

By the above operations, the colorants produced by ion-exchange with inorganic anions of adsorbents can be further put to ion-exchange with anions of inorganic salts or compounds. After regeneration of the said adsorbents, by repeating the adsorption and detachment for producing ion-exchange between anions of inorganic salts and colorants, the adsorbents can be regenerated and used again.

Moreover, aqueous solution of inorganic salts by the repeated uses can be saturated and condensed by colorants detached from the adsorbents. This saturated and condensed solution can be treated by burning and the like.

There is no restriction of the concentration and quantity of the aqueous solutions of inorganic salts used under the conditions with full ion-exchange with adsorbates.

Detailed explanation is made hereinafter on the present invention by examples, as follows:

Chromaticity was measured by the adsorbency of the visible ray with its wave-length of 420nm in accordance with the platinum standard solution method with reference to JIS L-101.

REFERENCE EXAMPLE 1

Magnesium chloride ($MgCl_2.6H_2O$) in a quantity of 143 g and sodium aluminate in as quantity of 47 g containing 25 g as $Al_2O_3$ were each put into a 1000 ml beaker and dissolved in water to make a solution of 700 ml. Both solutions were put into 600 ml-water in a beaker of 5 liters, being stirred by the use of a magnetic stirrer while the pH of the solution was kept at 8.5 by dropping 10%-NaOH solution under room-temperature, it was poured at the speed of about 24 ml/min by using a quantitative pump for 30 minutes, and the resulting gel was filtered and washed with water.

This substance consisted of $Al_2O_3$ 8.4%, MgO 8.9% and total water 80.5%, and one-time yield was 270 g.

This gel-like substance was dried at 110° C. for 16 hours, and was pulverized to obtain the powdered adsorbent (hereinafter referred to as Powdered Product 1).

This powder consisted of $Al_2O_3$ 25.4%, MgO 31.8% and total water-content was 41.8%.

The obtained powdered adsorbent in a quantity of 100 g was kneaded with binder (cement) in an amount of 5 g, and was formed into a cylinder-shape having a 0.5-0.8 mm diameter. After drying at the temperature of 110° C., firing was made at the temperature of 400° C. for preparing a formed adsorbent (hereinafter referred to as Granulated product 1).

REFERENCE EXAMPLE 2

Magnesium chloride in a quantity of 143 g was dissolved in water to make a solution of 700 ml, and also, sodium aluminate in a quantity of 31 g containing 18 g of $Al_2O_3$ and sodium silicate in a quantity of 8.6 g containing 6 g of $SiO_2$ were dissolved in water to make 700 ml. Other operations were the same as those of Reference Example 1, and the formed adsorbent and powder as in Reference Example 1 were obtained (hereinafter referred to as Powder Product 2 and Granulation Product 2).

This product consisted of $Al_2O_3$ 21.6%, MgO 31.9%, $SiO_2$ 6.7% and total water content 36.6%.

EXAMPLE 1

Powdered products 1 and 2, each in an amount of 10 g, obtained by Reference Examples was put into a beaker with 100 ml of beet juice of chromaticity 6,200 ppm (Pt). The solution was stirred and shaked for 210 minutes under the temperature of 70° C. Thereafter, the suspended adsorbent was centrifuged for isolation with the sedimentation.

The supernatant solution was filtered by C-filter paper, and the chromaticity of the filtered solution was measured. Thus, a decreased value was determined as an indication of decolorizing rate.

Next, the filtered adsorbent was put into a beaker with an aqueous solution with a quantity of 50 ml of 20%-$Na_2CO_3$, and was stirred for 20 minutes under the temperature of 70° C.

After filtration, the adsorbent was further washed with water for removing the aqueous solution of $Na_2CO_3$ completely.

The regenerated adsorbent was active again for decoloration of beet juice, and no decrease of adsorption-faculty was observed. This operation was repeated 10 times, and the removing rates are shown in Table 1.

EXAMPLE 2

Granulated products 1 and 2, in an amount of 60 g, were each loaded into a glass-column having a warming jacket. Beet juice with chromaticity 5,800 ppm (Pt) was circulated at the flow rate of SV 0.3 $hr^{-}$ at the temperature of 70° C. The chromaticity of the treated solution obtained at the outlet of the column was continuously measured.

As a result, 4.2–4.6 liters of beet juice could be treated with the concentration-ratio, between the outlet and inlet, up to 0.5 in the column of beet juice.

To this granulated products 1 and 2, 20%-$Na_2CO_3$ aqueous solution 250 ml was circulated at the temperature of 70° C., and adsorbates were detached. Moreover, attached $Na_2CO_3$ was removed by a little quantity of water, and adsorbent was washed.

The above adsorption and regeneration cycles were repeated 10 times, and it was possible to treat beet juice in the amount shown in Table 1.

Moreover, chromaticity of the $Na_2CO_3$-aqueous solution used for the regeneration 10 times was about 21,000 ppm (Pt), and chromaticity of the original beet juice was condensed up to about 36 times. Furthermore, the mechanical strength of the granulated product 1 used for the regeneration 10 times was shown in Table 3 as a result of measurement with the distribution of granularity. That is, the change was very minor as compared with new products. That is, the change was very minor as compared with new products.

EXAMPLE 3

In Example 2, the aqueous solution of 20%-$Na_2CO_3$ was replaced with 170 ml of 30%-$Na_2SO_4$ aquous solution, and the similar treatment was performed, thus similar to Example 1, the results shown in Tables 1 and 3 were obtained.

EXAMPLE 4

In the Example 2, 20%-$Na_2CO_3$ aqueous solution was replaced with 500 ml of 10%-$Na_2HPO_4$ aqueous solution, and the similar treatment was made. Thus results similar to those of the Example 1 were obtained as listed in Tables 1 and 3.

COMPARATIVE EXAMPLE 1

Similar adsorbing treatment to that of Example 1 and 2 was performed under room temperature as to the powdered products 1 and 2 as well as Granulated products 1 and 2. The results of decoloration-rate and the treated or disposed liquid (juice) volume were listed in Table 2.

Comparative Example 2

Powdered products 1 and 2 with similar adsorption-treatment to that of the Example 1 were washed with water, and dried at 110° C. for 16 hours. Then the disposal or treatment for regeneration was performed in a muffle furnace at 600° C. for 1.5 hour.

Each cycle of adsorption and regeneration was repeated 10 times, and the result of decoloration rate was listed in Table 1.

Comparative Example 3

Granulated products 1 and 2 treated with adsorption similar to that of Example 2 were washed with water. After extracting from the column, it was dried at 110° C. for 16 hours, and further, regeneration-treatment was made in a muffle furnace at 600° C. for 1.5 hour.

Each one cycle of the above operation of adsorption and regeneration was repeated 10 times, and the results of treated quantity and mechanical strength were listed in Tables 1 and 3.

TABLE 1

| Method | Specimen | | | | | | | | | | | |
|---|---|---|---|---|---|---|---|---|---|---|---|---|
| | Decoloration rate (%) Powdered product | | | | Treated quanity (lit.) of beet juice Granulated product | | | | | | | |
| | 1 | | 2 | | 1 | | | | 2 | | | |
| Regenerated times | Example 1 | Comparative example 2 | Example 1 | Comparative example 2 | Example 2 | Example 3 | Example 4 | Comparative example 3 | Example 2 | Example 3 | Example 4 | Comparative example 3 |
| 0 | 82.1 | 82.1 | 83.5 | 83.5 | 4.2 | 4.2 | 4.2 | 4.2 | 4.4 | 4.4 | 4.4 | 4.4 |
| 1 | 81.6 | 76.2 | 82.6 | 74.8 | 4.0 | 3.9 | 4.0 | 4.0 | 4.1 | 3.9 | 3.9 | 4.1 |
| 2 | 81.5 | 66.5 | 81.9 | 66.8 | 4.0 | 3.9 | 3.9 | 3.8 | 4.0 | 4.0 | 3.8 | 4.0 |
| 3 | 80.9 | 61.1 | 82.0 | 60.9 | 4.1 | 3.9 | 3.9 | 3.3 | 4.1 | 4.0 | 4.0 | 3.7 |
| 4 | 81.7 | 55.8 | 82.1 | 57.1 | 4.0 | 4.1 | 4.0 | 3.0 | 4.1 | 4.1 | 3.9 | 3.5 |
| 5 | 81.3 | 58.1 | 81.9 | 50.7 | 3.9 | 4.0 | 4.1 | 2.8 | 4.2 | 3.9 | 3.8 | 3.2 |
| 6 | 81.5 | 45.1 | 83.1 | 46.2 | 4.0 | 3.9 | 3.9 | 3.0 | 4.1 | 3.9 | 3.8 | 3.0 |
| 7 | 82.0 | 38.9 | 82.8 | 41.1 | 4.2 | 4.0 | 3.8 | 2.2 | 4.0 | 4.0 | 4.0 | 2.6 |
| 8 | 80.8 | 34.2 | 81.6 | 34.1 | 4.0 | 4.0 | 3.9 | 2.0 | 4.2 | 4.1 | 4.0 | 2.3 |
| 9 | 81.9 | 29.8 | 81.9 | 28.6 | 3.9 | 3.9 | 3.8 | 1.8 | 4.2 | 4.0 | 4.1 | 2.0 |
| 10 | 81.6 | 24.1 | 82.3 | 25.0 | 4.1 | 3.9 | 3.9 | 1.5 | 4.2 | 4.1 | 4.0 | 1.7 |

TABLE 2

| Specimen Method: | Decoloration rate (%) Powdered product 1 | 2 | Treatment quantity (lit.) Granulated product 1 | 2 |
|---|---|---|---|---|
| Example 1 | 82.1 | 83.5 | — | — |
| Example 2 | — | — | 4.2 | 4.4 |
| Comparative example 1 | 21.6 | 25.2 | 0.8 | 0.9 |

TABLE 3

| Method | Specimen: Granulated product 1 | | | | |
|---|---|---|---|---|---|
| | New product | Example 2 | Example 3 | Example 4 | Comparative example 3 |
| Granularity (Mesh) | | | | | |
| 20 up | 0.4 | 0.3 | 0.5 | 0.2 | 0.2 |
| 20–24 | 26.3 | 20.2 | 23.7 | 20.0 | 1.6 |
| 24–28 | 27.8 | 32.5 | 23.2 | 30.8 | 24.1 |
| 28–32 | 17.0 | 16.8 | 15.5 | 17.5 | 23.2 |
| 32–42 | 17.7 | 19.9 | 17.7 | 21.2 | 26.8 |
| 42–60 | 8.4 | 8.7 | 11.8 | 7.3 | 14.3 |
| 60 under | 2.4 | 1.6 | 7.6 | 2.8 | 9.8 |

Moreover, in accordance with the second embodiment of the invention, regeneration of the said adsorbent can be performed by heating the said adsorbent as high as 750°–950° C., preferably 800°–900° C., with the burining removal of adsorbates by burning. By this method, batch-system or continuous system can be optionally selected in accordance with the shape or form (powder or granule) of the said adsorbent.

Under the burning temperatures for regeneration at normal temperatures up to 450° C., the strength of the granular form can be maintained to a certain extent, however, by removal of the adsorbates is incomplete, the regenerating power may be insufficient.

At regenerating temperatures less than 450°–750° C., adsorbates are removed or extracted. However, the crystal-structure of the adsorbent itself becomes; solid-solution substance of MgO of Al or inactive MgO. Hence, regeneration of adsorbing function deteriorates greatly. Moreover, in the granular form, thermal expansion—contraction of the particle is great during the adsorption—regeneration reaction, and thus the mechanical strength is reduced.

At regenerating temperature over 950° C., adsorbates can be completely moved, and it is possible to maintain the mechanical strength of the granular form due to the formation of gamma-$Al_2O_3$ and spinel ($MgAl_2O_4$), whereas the crystalline particle-diameter is increased, and the surface-area is markedly decreased, thereby, the adsorption ability is stabilized at its lower level. While at regenerating temperatures 750°–950° C., preferably 800°–900° C., adsorbates can be fully removed.

Also, at such temperatures, mechanical strength as granular substance can also be maintained by a partial formation of $\gamma$-$Al_2O_3$ and spinel of $MgAl_2O_4$. Moreover, no increase is observed on the diameter of crystalline diameter, and the decrease of the surface is a little, thus no lowered function for adsorption occurs by the repetition of regeneration—adsorption.

Accordingly, the said adsorbent regenerated for a certain time at the temperature of 750°–950° C., preferably 800°–900° C., is again placed on the adsorbing process, and it becomes possible to make repeated use without damaging the adsorbing function semi-permanently. As noted above, it is a feature of the present invention that, the adsorbing function of the adsorbent can be maintained and elevated with the maintenance of the mechanical strength as granular substance, by making the regeneration at 200°–700° C. applicable for the general adsorbents in the use for the adsorption of organic substances.

A further additional feature of the inventive technique is that the regenerating atmosphere is not restricted to vapor, etc. in spite of the regeneration at rather higher temperatures.

EXAMPLE 1A

Each 5 g of Powdered products 1 and 2 obtained by Reference Examples was put into a beaker with beet juice in amount of 100 ml having a chromaticity 6100 ppm (Pt). It was stirred for 210 minutes at 70° C.

Thereafter, the suspended adsorbent was centrifuged, and its supernatant solution was filtered by C-filter paper. The chromaticity of the thus filtered solution was measured to determine the decoloration-rate as a function of a reduction in the amount of chromaticity.

Next, the filtered adsorbent was washed with a small quantity of water, and was dried at 110° C. for 16 hours, followed by calcination for one hour at 800° C. in a muffle furnace.

The adsorbent after regeneration was active on the occasion of decoloration of beet juice again, and no decrease of adsorbency was observed.

This operation was repeated 10 times, and the removal rate was shown in Table 4.

EXAMPLE 2A

Granulated products 1 and 2 obtained by the Reference Examples each in a quantity of 300 ml was filled in the column provided with a warming jacket, and beet juice having a chromaticity 6100 ppm (Pt) was introduced with flow rate of S.V. 0.3 hr at a temperature of 70° C. The treated solution at the outlet of the column was continuously measured on the chromaticity continuously.

The result showed the fact that concentration-ratio at the inlet was 0.5–0.6, and treatment of beet juice was done on its quantity of 26–37 liters.

Each of the above Granulated products, 1 and 2, was washed with warm water at 70° C., and taken out of the column, given a drying treatment at 110° C. for 16 hours, and calcinated in a muffle furnace at 800° C. for one hour.

The above one cycle of adsorption—regeneration was repeated 10 times.

The result was shown in Table 4, demonstrating the treated quantity of beet juice, and there was no decrease of the adsorption-function.

Moreover, the mechanical strength of Granulated product 1 used for regeneration 10 times was shown in Table 6 as a result of measurement due to the distribution of granularity, that is, the change was very little as compared with a new product.

EXAMPLE 3A

In Example 3A, by changing the firing temperature of 800° C. into 900° C., the similar operation was performed, the results are shown in Tables 4 and 6.

COMPARATIVE EXAMPLE 1A

Similar adsorption-treatment to that of Examples 1A and 2A was performed at room-temperature for the Granulated products 1 and 2 as well as Powdered products 1 and 2. The result was shown in Table 5 on decoloration-rate and the quantity of the treated solution.

Table 2 also shows the decoloration-rate by Powdered products 1A and 2 obtained by Example 1, and the quantity of the treated solution (beet juice) by Granulated Products 1 and 2 obtained by Example 2A.

COMPARATIVE EXAMPLE 2

Powdered product 1 and 2 used for adsorption-treatment similar to that of Example 1A was washed with water, and dried at 110° C. for 16 hours, thereafter, regeneration-treatment was made by heating at 600° C. for 1.5 hour.

The above one cycle of adsorption-regeneration was repeated 10 times, and the results are shown in Table 1 on the decoloration rate.

COMPARATIVE EXAMPLE 3A

Powdered products 1 and 2 used for adsorption-treatment similar to that of Example 1A was each washed with water and dried at 110° C. for 16 hours, and regeneration was performed by heating at 1000° C. for 1.5 hours in a muffle furnace.

The above one cycle of adsorption-regeneration was repeated 10 times, and the result of decoloration was shown in Table 4.

COMPARATIVE EXAMPLE 4A

Granulated product 1 and 2A treated with adsorption similarly to Example 2 was washed with water and taken out of the column, and dried at 110° C. for 16 hours. Further, it was treated with regeneration by heating at 600° C. for 1.5 hour in a muffle furnace.

This one cycle of adsorption-regeneration was repeated 10 times, the results of treated quantity of beet juice and mechanical strength are shown in Tables 4 and 6.

COMPARATIVE EXAMPLE 5A

Granulated product 1 and 2 treated with adsorption similarly to Example 2A was washed with water, and taken out of the column, It was dried at 110° C. for 16 hours, and was regenerated at 1000° C. in a muffle furnace for 1.5 hour.

The above one cycle of adsorption-regeneration was repeated 10 times, and the results are shown in Tables 1 and 3 as to the treated quantity of beet juice and mechanical strength.

TABLE 4

| Measurement | Decoloration rate (%) Powdered product | | | | | | Treated quanity (lit.) of beet juice Granulated product | | | | | | | |
|---|---|---|---|---|---|---|---|---|---|---|---|---|---|---|
| | 1 | | | 2 | | | 1 | | | | 2 | | | |
| Specimen Method | | Comparative | Comparative | | Comparative | Comparative | | | Comparative | Comparative | Example | | Comparative example | |
| Regenerated times | Example 1A | example 2A | example 3A | Example 1A | example 2A | example 3A | Example 2A | Example 3A | example 4A | example 5A | 2A | 3A | 4A | 5A |
| 0 | 84.8 | 84.8 | 48.2 | 86.1 | 86.1 | 50.3 | 31 | 28 | 31 | 13 | 32 | 30 | 32 | 15 |
| 1 | 85.1 | 80.2 | 47.7 | 85.6 | 81.8 | 49.9 | 34 | 28 | 30 | 12 | 31 | 28 | 30 | 12 |
| 2 | 83.9 | 71.1 | 48.1 | 86.4 | 73.6 | 48.7 | 32 | 29 | 28 | 15 | 35 | 28 | 28 | 11 |
| 3 | 84.2 | 62.0 | 47.2 | 85.9 | 64.2 | 50.1 | 37 | 26 | 24 | 11 | 30 | 29 | 26 | 12 |
| 4 | 84.9 | 54.1 | 47.8 | 85.5 | 57.0 | 48.8 | 35 | 27 | 21 | 14 | 33 | 31 | 23 | 14 |
| 5 | 83.6 | 49.2 | 49.1 | 85.5 | 52.1 | 50.5 | 35 | 29 | 19 | 13 | 31 | 27 | 21 | 13 |
| 6 | 84.4 | 40.3 | 47.7 | 86.0 | 44.3 | 49.8 | 34 | 28 | 16 | 13 | 30 | 27 | 16 | 12 |
| 7 | 84.1 | 32.8 | 46.9 | 86.3 | 37.5 | 49.8 | 35 | 28 | 16 | 11 | 32 | 28 | 17 | 14 |
| 8 | 84.6 | 21.6 | 48.1 | 85.4 | 29.7 | 50.5 | 33 | 29 | 13 | 12 | 30 | 26 | 14 | 12 |
| 9 | 83.9 | 19.8 | 47.6 | 86.1 | 23.3 | 48.9 | 34 | 28 | 11 | 13 | 31 | 27 | 12 | 13 |
| 10 | 84.7 | 15.3 | 47.9 | 86.1 | 19.9 | 50.1 | 35 | 29 | 10 | 13 | 33 | 27 | 10 | 14 |

TABLE 5

| Measurement Specimen | Decoloration rate (%) Powdered product | | Treated quantity (lit.) Granulated product | |
|---|---|---|---|---|
| Method | 1 | 2 | 1 | 2 |
| Example 1A | 84.8 | 86.1 | — | — |
| Example 2A | — | — | 31 | 32 |
| Comparative example 1A | 19.3 | 21.9 | 3.8 | 4.1 |

TABLE 6

| Method Granularity (mesh) | Specimen Granulated product 1 New product | Example 2A | Example 3A | Comparative example 4A | Comparative example 5A |
|---|---|---|---|---|---|
| 20 up | 0.8 | 0.4 | 0.4 | 0.1 | 0.6 |
| 20–24 | 8.4 | 9.2 | 8.5 | 1.7 | 8.2 |
| 24–28 | 26.2 | 15.6 | 20.2 | 6.3 | 21.6 |
| 28–32 | 33.8 | 32.5 | 32.3 | 14.7 | 33.1 |
| 32–42 | 29.2 | 39.0 | 35.4 | 60.3 | 34.2 |
| 42–60 | 1.2 | 2.8 | 3.0 | 15.4 | 1.8 |
| 60 under | 0.2 | 0.4 | 0.2 | 1.7 | 0.3 |

What we claim is:

1. A method of refining beet juice having a colorant comprising the step of contacting the beet juice with an adsorbent in a temperature range of 40° to 100° C. to form an adsorbate thereby decoloring the beet juice, said adsorbent being a dehydrated solid of a coprecipitated substance formed by insolubilizing metallic compounds in an aqueous solution containing at least one metallic component selected from the group consisting of calcium and magnesium and at least one metallic component selected from the group consisting of aluminum and iron.

2. The method of claim 1 further comprising subjecting the adsorbent to at least one of the following steps; contacting said adsorbent with an aqueous solution of inorganic salt to regenerate said adsorbent, and heating said adsorbent to a temperature in the range of 750° to 950° C. to regenerate said adsorbent.

3. The method of claim 1 wherein the adsorbent is in powdered form, including mixing a quantity of the powdered adsorbent with a quantity of the beet juice to form a mixture, and removing the powdered adsorbent with the adsorbate from the mixture.

4. The method of claim 1 including forming the adsorbent into granules, filling the granules into a column container, and supplying the beet juice to the container through the granules of adsorbent.

5. The method of claim 1 further comprsing heating said adsorbent to a temperature in the range of 750° to 960° to regenerate said adsorbent.

6. The method of claim 5 wherein said adsorbent is heated to a temperature range of 800° to 900° C.

7. The method of claim 1 further comprising contacting said adsorbent with an aqueous solution of inorganic salt to regenerate said adsorbent.

8. The method of claim 7, wherein said inorganic salt is chosen from the group consisting of carbonate salts, sulfate salts and phosphate salts.

9. The method of claim 8, wherein the carbonate, sulfate and phosphate radicals of said carbonate, sulfate and phosphate salts respectively each have a valance of −2.

10. The method of claim 1 wherein the beet juice is contacted with the adsorbent in a temperature range of 60° to 80° C.

11. The method of claim 10 further comprising the step of heating said adsorbent to a temperature in a range of 750° to 950° C. to regenerate said adsorbent.

12. The method of claim 11 wherein said adsorbent is heated to a temperature range of 800° to 900° C.

* * * * *

UNITED STATES PATENT AND TRADEMARK OFFICE

CERTIFICATE OF CORRECTION

PATENT NO. : 4,264,373

DATED : April 28, 1981

INVENTOR(S) : Keisuke Shinbori, et al

It is certified that error appears in the above—identified patent and that said Letters Patent is hereby corrected as shown below:

On the Title page Item [73] should read:

--Toyo Soda Manufacturing Co., Ltd, Yamagichi-Ken, Japan and Japan Organo Co. Ltd., Hongo, Bunky, Ku, Japan--.

Signed and Sealed this

Seventeenth Day of November 1981

[SEAL]

Attest:

GERALD J. MOSSINGHOFF

Attesting Officer

Commissioner of Patents and Trademarks